US008210949B2

(12) United States Patent
Graf

(10) Patent No.: US 8,210,949 B2
(45) Date of Patent: Jul. 3, 2012

(54) GAMING, GAMBLING AND/OR ENTERTAINMENT DEVICE

(75) Inventor: Johann F. Graf, Gumpoldskirchen (AT)

(73) Assignee: Novomatic AG, Gumpoldskirchen (AU)

( * ) Notice: Subject to any disclaimer, the term of this patent is extended or adjusted under 35 U.S.C. 154(b) by 763 days.

(21) Appl. No.: 12/084,186

(22) PCT Filed: Oct. 26, 2006

(86) PCT No.: PCT/EP2006/010336

§ 371 (c)(1),
(2), (4) Date: Mar. 5, 2009

(87) PCT Pub. No.: WO2007/048610

PCT Pub. Date: May 3, 2007

(65) Prior Publication Data

US 2009/0209324 A1 Aug. 20, 2009

(30) Foreign Application Priority Data

Oct. 27, 2005 (AT) ..... GM731/2005

(51) Int. Cl.
*A63F 9/24* (2006.01)

(52) U.S. Cl. ..... 463/46; 463/47

(58) Field of Classification Search ..... 463/16–20, 463/30, 40, 42, 46, 47
See application file for complete search history.

(56) References Cited

U.S. PATENT DOCUMENTS

| | | | | |
|---|---|---|---|---|
| 6,068,101 | A | 5/2000 | Dickenson et al. | |
| 6,135,884 | A * | 10/2000 | Hedrick et al. | 463/20 |
| 6,272,575 | B1 | 8/2001 | Rajchel | |
| 6,699,128 | B1 | 3/2004 | Beadell et al. | |
| 2002/0151353 | A1 | 10/2002 | Gauselmann | |
| 2003/0054880 | A1 * | 3/2003 | Lam et al. | 463/29 |
| 2004/0023716 | A1 | 2/2004 | Gauselmann | |
| 2004/0254006 | A1 * | 12/2004 | Lam et al. | 463/16 |
| 2005/0064942 | A1 * | 3/2005 | Hedrick et al. | 463/46 |
| 2005/0215325 | A1 * | 9/2005 | Nguyen et al. | 463/46 |
| 2007/0010318 | A1 * | 1/2007 | Rigsby et al. | 463/20 |
| 2008/0254880 | A1 * | 10/2008 | Dreyer et al. | 463/31 |

FOREIGN PATENT DOCUMENTS

| | | |
|---|---|---|
| AT | 405339 | 11/1998 |
| DE | 9110013 | 10/1991 |
| DE | 19749703 | 4/1998 |
| DE | 212004000009 | 7/2005 |
| EP | 1001391 | 5/2000 |
| EP | 1522978 | 4/2005 |
| GB | 2350913 | 12/2000 |

* cited by examiner

*Primary Examiner* — Peter DungBa Vo
*Assistant Examiner* — Steve Rowland
(74) *Attorney, Agent, or Firm* — Dilworth & Barrese, LLP.

(57) ABSTRACT

A gaming, betting and/or entertainment machine, in particular a coin-and/or cash-operable gaming or betting machine, has a housing, a data processing unit accommodated in the housing, at least one display device for displaying game and/or entertainment signals, and an operating device for machine operation, which is disposed on the housing. The housing has a modular structure and a plurality of modules to be attached to each other, which each are preassembled with the electronic components attached thereto. A first housing module, which carries the data processing unit and possibly the operating means, includes a first connection interface, by which a respective second housing module, which carries the respective display device, can selectively be attached to the first housing module. The data processing unit in the first housing module advantageously has a detection device for self-detection of the respectively connected electronic components in or on the respectively attached further housing modules. This provides for a plug-and-play configuration of the machine.

5 Claims, 4 Drawing Sheets

GAMING, GAMBLING AND/OR ENTERTAINMENT DEVICE

BACKGROUND OF THE INVENTION

The present invention relates to a gaming, betting and/or entertainment machine, in particular a coin- and/or cash-operable gaming or betting machine, comprising a housing, a data processing unit accommodated in the housing, at least one display device for displaying game and/or entertainment signals, and an operating means for machine operation, which is disposed on the housing.

A gaming machine as mentioned above is known for instance from WO 2005/041139 A1 or DE 200 00 990 U1. While the last-mentioned DE 200 00 990 U1 discloses a reel-spinning gaming machine, in which the fortune reels bearing the symbols are spinning in a display field made of glass, the first-mentioned WO 2005/041139 A1 discloses a monitor machine, in which the display device comprises two monitors disposed one on top of the other, which are inclined with respect to each other at an obtuse angle. In such gaming machines, the machine housing regularly is formed as cabinet, wherein the display device is arranged in the upper half of the cabinet-like housing, while in the lower portion of the housing the data processing unit or control means for machine control and possibly a payout means for paying out the winnings of a game are accommodated. In a middle housing below the display device, the operating means regularly is provided, which is connected with the control means and beside the function keys for machine control can also include money or cash value input means. It is known to provide the cabinet-like machine housing with a door which can be swivelled about an upright axis, in order to gain access to the components disposed inside the housing (cf. WO 2005/041139).

Furthermore, it is known from EP 15 22 978 A1 to accommodate the money input unit with banknote reader in a separate housing compartment, which can laterally be screwed to the main housing. In a manner known per se, the main housing accommodates the data processing unit for machine control in its lower portion and the display device of the machine in an upper portion. Between the two, the operating panel for game control likewise is provided on the main housing in a manner known per se. The separate accommodation of the money input unit allows to provide the same only if necessary, but to completely omit the same when the machine is formed without money input unit.

Such gaming machines are, however, capable of improvement in several respects. On the one hand, in known gaming or entertainment machines it is relatively-difficult to individually configure the machine corresponding to the wishes of the customer. In particular, the known machines have little. flexibility as regards the display device and the money output and/or input device. The cut-outs in the upper half of the machine housing firmly specify the arrangement of the display means, such as monitors or displays. In the gaming machine known from WO 2005/041139, for instance, it is not easily possible to replace one of the two large monitors provided there, which are inclined with respect to each other at an obtuse angle, by a display field for spinning game reels. On the other hand, it would be desirable to improve the maintenance and repair friendliness of the machine. If a defect occurs for instance in the vicinity of the display device, the entire machine must be replaced so far or the display device must be removed on the spot with great effort. Furthermore, it would be advantageous to improve the transportability of the bulky machines.

SUMMARY OF THE INVENTION

Therefore, it is the object underlying the present invention to create an improved gaming and/or entertainment machine as mentioned above, which avoids the disadvantages of the prior art and develops the latter in an advantageous way. Preferably, an improved gaming machine should be created, which can easily be configured individually corresponding to the wishes of the customer, facilitates maintenance and repair, and has an easy transportability.

In accordance with the invention, this object is solved by a gaming and/or entertainment machine according to the description herein. Preferred aspects also form the subject matter of the invention herein.

In accordance with the invention, it thus is provided that the housing has a modular structure and consists of a plurality of modules to be put together, which each are preassembled with the electronic components attached thereto. A first housing module, which carries the operating means and/or the data processing unit of the machine, includes a first connection interface, by means of which various second housing modules, which have the respectively desired display device, can selectively be attached to said first housing module. Depending on the desired configuration, the modular structure of the machine housing allows to mount various display device housing modules on the control or operating housing module. For instance, a housing module with two monitors inclined with respect to each other at an obtuse angle, as shown for instance in WO 2005/041139, can be mounted on the housing module which carries the operating means and/or the data processing unit. If, on the other hand, a differently formed display device is desired, a correspondingly differently formed second housing module with display means premounted thereto can be mounted on the same. For instance, the second housing module, which carries the respective display device, can comprise two monitors not inclined with respect to each other, include only one monitor or also have a display field made of glass with spinning game reels disposed behind the same, in order to be able to configure the machine as a reel-spinning machine. It should be appreciated that combinations of monitor and reel display field are also possible. Due to the modular structure of the machine housing, not only manufacturing and assembly costs as well as warehousing costs for the different machine housings can be reduced, but maintenance friendliness can also be improved. If a gaming machine breaks down for instance in the vicinity of the display device, it is not necessary to replace the entire machine or remove and install again the display device on the spot. Rather, the housing module including the display device can be removed and be replaced by a new one. The transportability of the machines also can be improved, as the housing modules with the preassembled electronic components possibly can be transported separately, if necessary. A gaming machine likewise can be reconfigured relatively easily. If for instance after a certain operating time in a casino, a machine with only one monitor should be converted into a dual monitor machine, it is merely necessary to remove the second housing module and replace the same by one of a correspondingly different design.

The data processing unit in said first housing module advantageously comprises a detection means for self-detection of the respectively connected electronic components in or on the respectively mounted further housing modules. This enables, so to speak, a plug-and-play configuration of the machine. If, for instance, a pure reel-spinning gaming machine should be reconfigured into a reel-spinning and monitor machine, it is merely necessary to remove the aforementioned second housing module with the reel module and replace the same by a new second housing module, which includes the reel module and in addition a monitor. When connecting the reel module and the monitor of the new second housing module with the data processing unit in the first housing module, the data processing unit detects the newly connected components and correspondingly provides the necessary control signals.

In accordance with an advantageous aspect of the invention it can be provided that the data processing means is connectable with a software and/or a control signal memory, in which for different electronic components different software modules and/or different control signals can be stored, from which in dependence on the electronic component each detected by the detection means a software module suitable for the detected electronic component and/or suitable control signals can be selected and/or derived by the data processing means. Preferably, the data processing means automatically determines the software appropriate for the respectively connected electronic component and correspondingly provides the appropriate control commands, so that reprogramming or importing corresponding software can be omitted. Nevertheless, it would also be possible to first of all merely display the respective component detected by the detection means on the display-means and then import or configure an appropriate software. The aforementioned automatic adaptation of the control of the machine considerably simplifies the configuration of the machine and provides for a complete plug-and-play.

The automatic adaptation of the control need not be restricted to the detected electronic component itself, but the data processing means rather can vary or adapt the control of other modules in dependence on the respectively detected module, for instance vary the control of the display device and/or the control and/or the assignment of the operating means in dependence on the respectively detected electronic component. Advantageously, a key assignment of the operating means can be adapted to the respectively connected and detected electronic component or for instance in the case of a touch screen provided for the operating means, a control panel mask appropriate for the respectively detected component can be generated and scanned.

Advantageously, the modularity of the machine housing does to refer to the connectability of a plurality of different display device modules. In accordance with a development of the invention, said first housing module, which carries the operating means and/or the data processing unit of the machine, in addition to said first connection interface for the second housing module carrying the display device carries at least one further connection interface for mounting a third housing module, which carries a payout unit for paying out the stakes and/or winnings of a game.

Thus, said first housing module forms a central housing module, so to speak, which has a plurality of connection interfaces, so that depending on the desired configuration a plurality of further housing modules with the respective functional components provided thereon can be attached.

If, for instance, a pure card or ticket machine should be created, in which no distribution of winnings in the form of cash is provided, the aforementioned payout unit can be omitted. In this case, said third housing module with the payout unit attached thereto simply is omitted. Instead, for instance a fourth housing module, which forms a pedestal, can directly be attached to the first housing module, which includes the operating means and/or the data processing unit of the machine. For this purpose, said fourth housing module advantageously has a connection interface, by means of which it can selectively be put together with the first housing module, which carries the operating means and/or the data processing unit, or with the third housing module with the payout unit, when the latter is mounted on the first housing module.

By attaching machine pedestals of different heights, the modular attachability of a housing module forming the machine pedestal also allows to vary the overall height of the machine, in particular the arrangement of the operating unit and the display device, for instance adapt the same to different sizes.

Advantageously, the third housing module with the payout unit has complementary connection interfaces on opposite sides, one of which can be put together with the second connection interface of the first housing module and the other one corresponds to said second connection interface of the first housing module, so that the fourth housing module, which can form the pedestal of the machine, can selectively be mounted on the first housing module or on the third housing module mounted thereon.

In principle, the connection interfaces of the individual housing modules can be provided at different points of the housing modules. In accordance with an advantageous embodiment of the invention, the connection interfaces each are provided on the upper and/or lower surfaces of the respective housing modules, so that the housing modules can be stacked one on top of the other in a tower-like fashion, in order to be put together to a generally tower-like housing.

Advantageously, all electronic components in the various housing modules can be actuated by the central data processing unit in the first housing module. For this purpose, data transmission lines can be provided between the housing modules, which advantageously have releasable junction points, so that an easy separation of the housing modules or of the electronic components premounted thereto is possible. Advantageously, the housing modules or the electronic components premounted thereto can also be connected with each other by power supply lines, so that a central power supply, for instance via the first housing module, is possible. Alternatively, the housing modules might, however, also have separate power connections, to provide for a decentralized power supply.

Advantageously, the data processing unit is formed such that various games can be stored in the data processing unit. In accordance with one embodiment of the invention, the data processing unit can comprise a re-writeable memory, such as an EPROM, which allows to store the new game software and the control software determined for the newly connected machine components in the case of a reconfiguration of the machine.

In principle, the connection interfaces on the machine housing modules can be formed differently. In accordance with an advantageous embodiment of the invention, the connection interfaces are formed by the edges of preferably rectangular housing openings of the respective housing modules. The edges can have mounting guideways, for instance in the form of stepped grooves, so that they can precisely be placed one on top of the other and are positively held transverse to the mounting direction. Due to the arrangement of the interfaces on the upper and lower surfaces of the housing modules, the same basically are maintained in the assembled condition already as a result of gravity. Additionally, however, locking means or other positive or frictional holding means can also be provided, which hold the housing modules against each other in the assembled condition.

Advantageously, necessary data transmission lines are integrated in the connection interfaces between the modules with releasable junction points, such that the junction points of the data transmission lines are closed when joining two housing modules. However, separate data transmission interfaces, which can be connected or separated independent of putting together the housing modules, are also possible. An advantageous embodiment can consist in that the junction points of the data transmission lines are provided in the form of connectors, which have a coupling direction substantially parallel to the mounting direction of the housing interfaces, so that they are coupled or decoupled automatically, so to speak, when the corresponding housing modules are mounted on each other.

BRIEF DESCRIPTION OF THE DRAWINGS

The invention will subsequently be explained in detail with reference to preferred embodiments and associated drawings, in which.

DESCRIPTION OF THE PREFERRED EMBODIMENTS.

Figure 1:
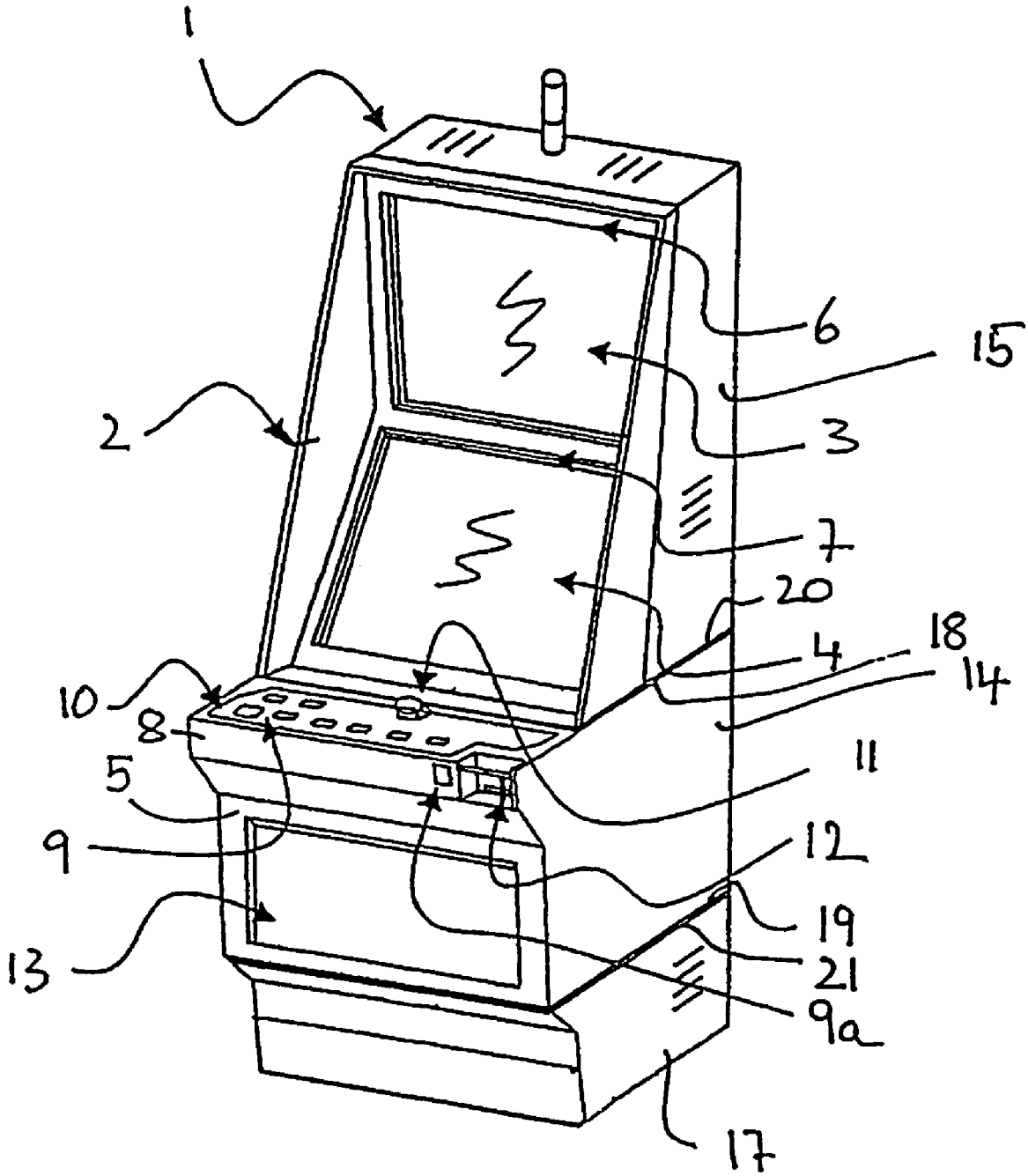
FIG. 1: shows a perspective front view of a gaming machine in accordance with a first embodiment of the invention, in which on a first housing module, which includes the operating means and the data processing unit of the gaming machine, a second housing module with two monitors is mounted, which are inclined with respect to each other at an obtuse angle.

The gaming machine illustrated in FIG. 1 forms a free-standing machine in the form of a standalone machine and comprises an approximately head-high, roughly speaking box-shaped machine housing 1, whose upper half serves to accommodate a display device 2, which in the illustrated embodiment consists of two large-surface monitors 3 and 4 arranged one on top of the other. As shown in FIG. 1, the gaming machine housing 1 has two cut-outs 6 and 7 for this purpose in its front side 5, which include an obtuse angle, so that the monitors 3 and 4 disposed one on top of the other likewise are tilted with respect to each other at an obtuse angle about a horizontal axis.

Below the two monitors 3 and 4, the gaming machine housing 1 has a control panel portion 8 protruding towards the player, which extends across the entire width of the machine housing 1 and is formed substantially box-shaped. The upper surface of the control panel portion 8 of the machine housing 1 is formed approximately flat and accommodates the control panel 10, which comprises a plurality of manually operable function keys 9 in the form of pressure switches. In the illustrated embodiment, the function keys 9 are mechanical switches, but it should be appreciated that the function keys 9 can also be actuatable according to other action principles, and can in particular form part of a touch screen. In a manner known per se, the control panel portion 8 furthermore can comprise a money input and/or output unit 11, which in a manner known per se can of course be formed differently and beside a coin and banknote module can for instance also comprise a token and/or ticket module or an electronic card reading and writing device.

Concretely, the control panel 10 includes a start key 9*a* arranged on the front side of the control panel portion 8 beside a handle 12 and on the flat upper surface a plurality of function keys, for instance for increasing the stakes of the game, for retrieving game information or for controlling further game functions, such as stopping, retarding or accelerating the spinning game reels displayed on one of the monitors 3 or 4.

The games displayed on the monitors 3 and 4 are controlled by an electronic control means 13 preferably in the form of a computer, which is accommodated inside the machine housing 1 in its lower half. The control means 13 on the one hand actuates the display device 2 and on the other hand communicates with the function keys 9 of the control panel 10. It should be appreciated that the money output means is also actuated by the control means 13.

As shown in FIG. 1, the machine housing 1 has a modular structure and is composed of a plurality of housing modules 14, 15 and 16, which are stacked one on top of the other in a tower-like fashion and together form the generally box-shaped machine housing 1. A first housing module 14 forms a central housing module, which on the one hand accommodates the aforementioned control means 13 in its interior and on the other hand carries the control panel 10 with the function keys 9 and the money input unit 11. This central first housing module 14 carries a second housing module 15, in which the monitors 3 and 4 are mounted. For this purpose, the first housing module 14 has a first connection interface 18 on its upper surface, which can accurately be connected with a connection interface 20 on the lower surface of the second housing module 15. The two connection interfaces 18 and 20 are formed by substantially congruent housing openings of the two housing modules 14 and 15, to be more precise by the edges defining these housing openings.

On its lower surface, the first housing module 14 has a second connection interface 19, with which the first housing module 14 can be mounted on a fourth housing module 17, which forms a housing pedestal with which the machine can be erected on the ground. On its upper surface, said pedestal module 17 has a suitable connection interface 21, which can accurately be put together with the second connection interface 19 of the housing module 14. The second connection interface 19 of the housing module 14 like the connection interface 18 on the upper surface is formed by the housing edges which define a housing opening in the lower surface of the housing module 14.

Figure 2:
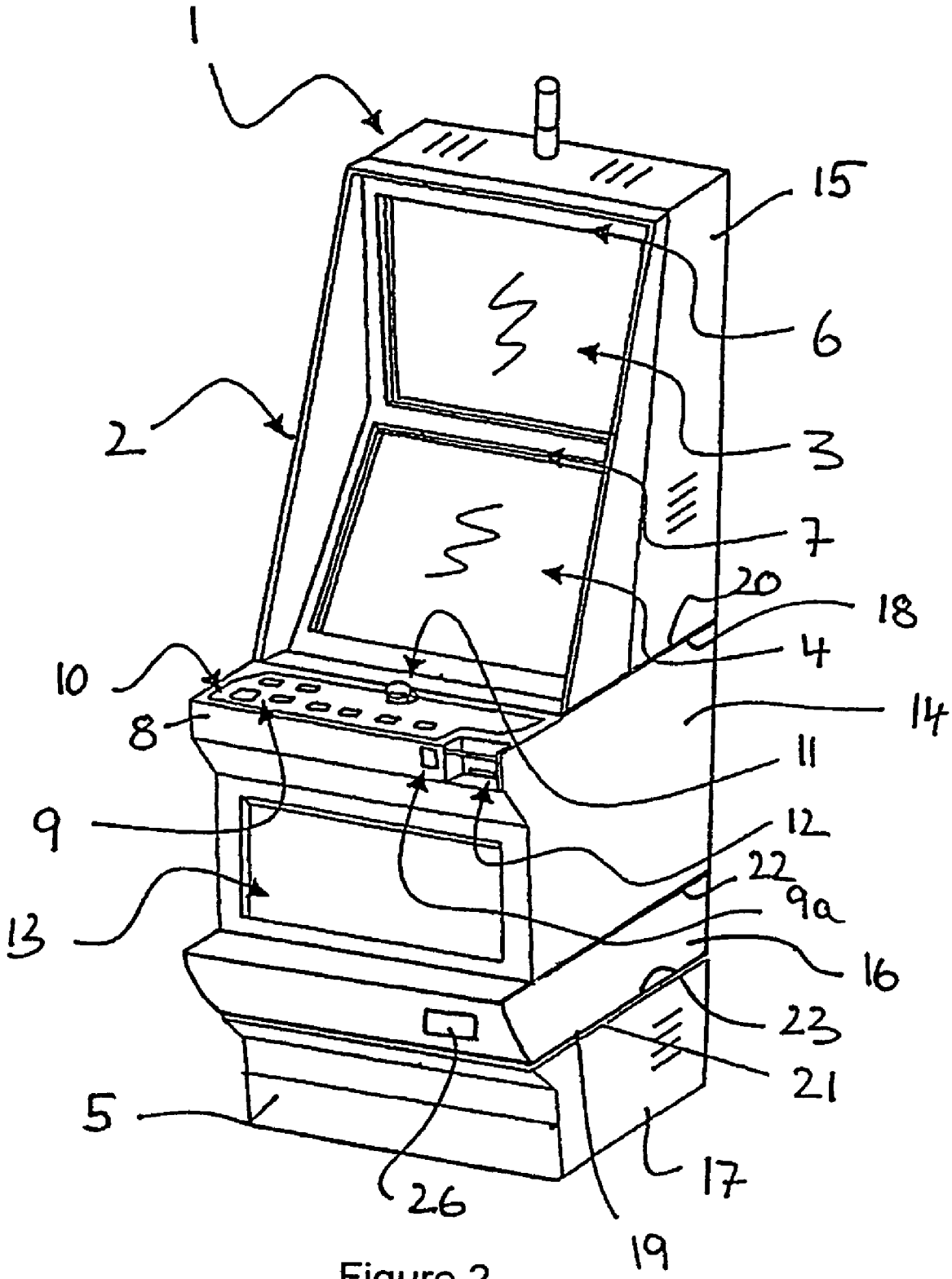
FIG. 2: shows a perspective front view of the gaming machine of FIG. 1, wherein a third housing module with a payout unit is inserted in the machine housing between the aforementioned first housing module and a fourth housing module, which forms the machine pedestal.

Due to the modular structure of the machine housing 1, it is easy to change the machine configuration. As shown in FIG. 2, a further housing module 16, which comprises a payout unit for paying out unused stakes and/or winnings of a game, can for instance be provided between the first housing module 14 and the housing module 17 forming the machine pedestal. For this purpose, the additional housing module 16 with the payout unit has connection interfaces 22 and 23 on its upper surface and on its lower surface, which as mentioned before in turn are formed by housing openings and the edges of the housing module 16 defining the same.

Advantageously, the connection interface 22 on the upper surface of the housing module 16 is complementary to the second connection interface 19 of the first housing module 14, so that the same can accurately be put together. On the other hand, the second connection interface 23 of the additional housing module 16 advantageously identically corresponds to the second connection interface 19 of the first housing module 14, so that the pedestal module 17 can selectively directly be attached to the central first housing module 14 or the additional housing module 16.

Figure 3:
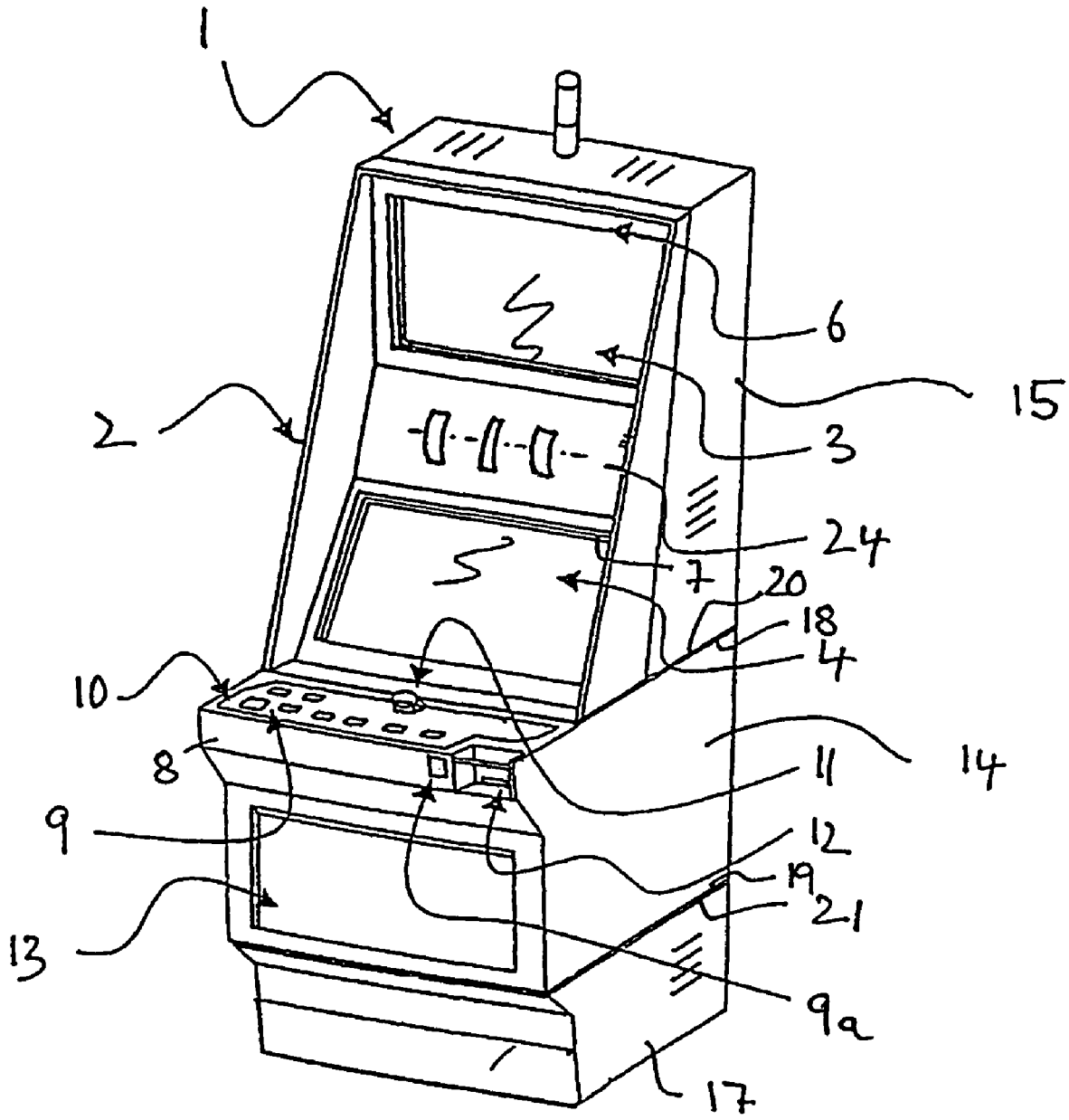
FIG. 3: shows a perspective front view of the gaming machine of the preceding Figures, wherein the second housing module with the display monitors of FIG. 1 is replaced by another second housing module, which includes two monitors and in addition a reel module.

As shown in FIG. 3, the gaming machine can quite easily be provided with a differently formed display device 2. For this purpose, it is merely necessary to replace the second housing module 15. In the illustrated embodiment, the second housing module 15 comprises a reel module 24 in addition to the two display monitors 3 and 4.

Figure 4:
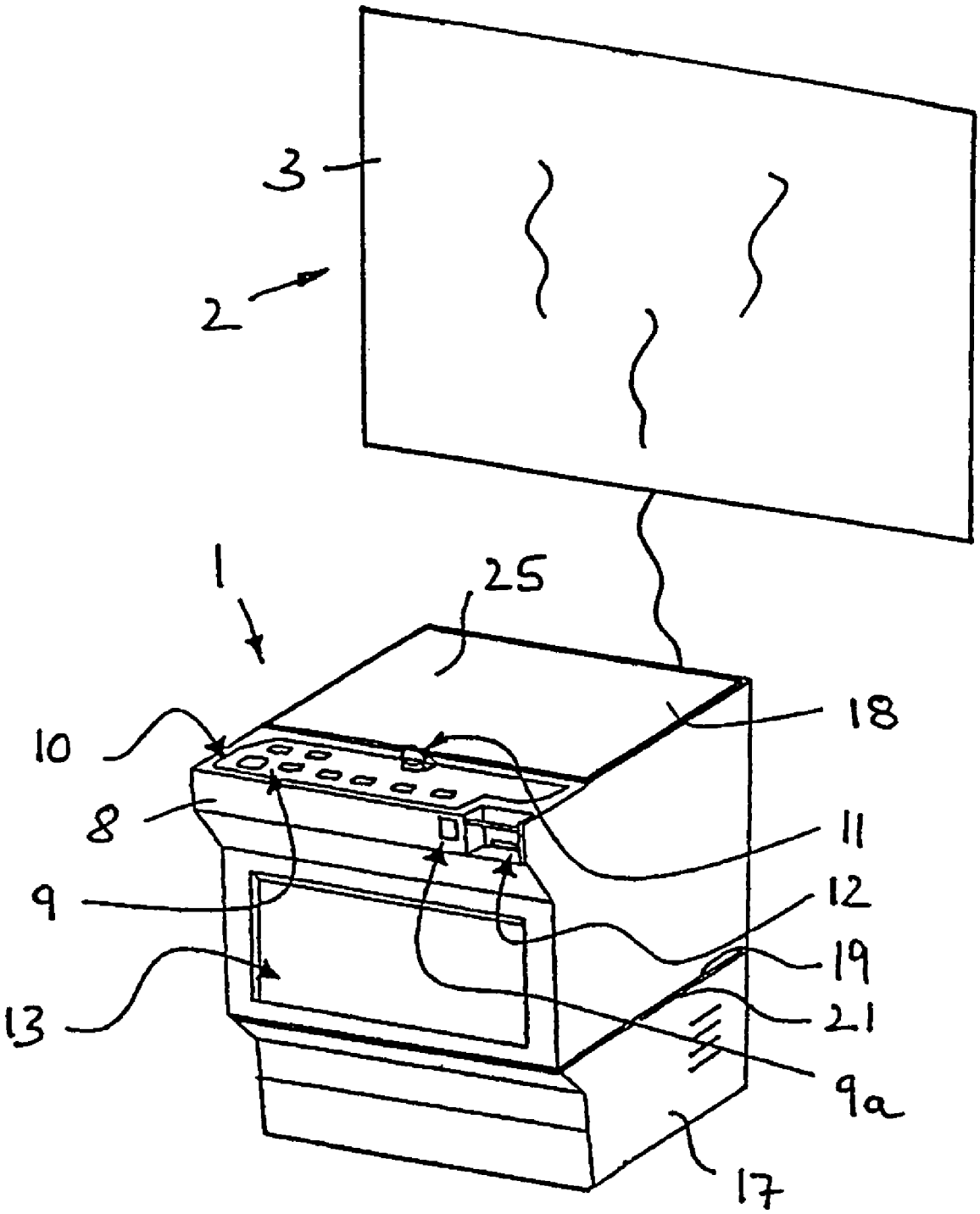
FIG. 4: shows a perspective front view of the gaming machine of the preceding Figures, wherein the second housing module with the display monitors is replaced by a large monitor, which no longer is directly attached to the machine housing, but is mounted to a wall.

As shown in FIG. 4, the second housing module 15 with the display device 2 also can completely be removed from the remaining housing modules 14 and 17. The connection interface 18 on the first housing module 14 is closed by a lid 25. The display device 2 can comprise a large monitor 3, which is suspended separate from the housing 1, for instance on a building wall.

The invention claimed is:

1. A gaming, betting or entertainment machine, in particular a coin-operable or cash-operable gaming or betting machine, comprising:

a machine housing (1), a data processing unit (13) accommodated in the machine housing (1), at least one display device (2) for displaying at least one of game and entertainment signals, and an operating means (10) for machine operation, which is disposed on the machine housing (1), wherein the machine housing (1) has a modular structure and a plurality of machine housing modules to be attached to each other, which each are preassembled with the electronic components attached thereto, wherein a first machine housing module (14), which carries the data processing unit and preferably the operating means, includes a first connection interface, by which a respective second machine housing module (15), which carries the respective display device (2), can selectively be attached to the first machine housing module (14), wherein data transmission lines with releasable junction points are provided between the machine housing modules (14, 15, 16, 17), wherein the data processing unit (13) in the first machine housing module (14) includes a detection means for self-detection of the respectively connected electronic components of the respectively mounted machine housing modules (15, 16, 17), wherein in addition to said first connection interface (18) for the second machine housing module (15) carrying the display device, the first machine housing module (14) includes a further connection interface (19) for attaching a third machine housing module (16), which carries a payout unit (26), wherein a fourth machine housing module (17), which forms a machine housing pedestal, has a connection interface (21), by means of which it can selectively be attached to the first machine housing module when the third machine housing module (16) is not included (14) and to the third machine housing module (16) when the third machine housing module (16) is included, wherein the connection interfaces (18, 19, 20, 21, 22, 23) of the machine housing modules (14, 15, 16, 17) are arranged on the upper and lower surfaces of the machine housing modules (14, 15, 16, 17), so that the machine housing modules (14, 15, 16, 17) can be stacked one on top of the other in a tower-like fashion, wherein the third machine housing module (16) with the payout unit (26) has complementary connection interfaces (22, 23) on opposite sides, one of which can be put together with the second connection interface of the first machine housing module (14) and the other one corresponds to the second connection interface (19) of the first machine housing module (14), so that at least one of the second machine housing module (15) and the fourth machine housing module (17) selectively can directly be attached to the first machine housing module (14) and to the third machine housing module (16) mounted thereon, and wherein the first connection interface (18) and the second connection interface (19) of the first machine housing module (14) are formed complementary to each other, so that the third machine housing module (16) selectively can be placed between the first machine housing module and the second machine housing module or between the first machine housing module and the fourth machine housing module.

2. The gaming, betting or entertainment machine according to claim 1, wherein the data processing unit (13) in the first machine housing module (14) actuates the further electronic components in the other machine housing modules (15, 16, 17).

3. The gaming, betting or entertainment machine according to claim 1, wherein the connection interfaces (18, 19, 20, 21, 22, 23) of the machine housing modules (14, 15, 16, 17) are formed by the edges of preferably rectangular machine housing openings in the machine housing modules (14, 15, 16, 17).

4. The gaming, betting or entertainment machine according to claim 1, wherein the data processing means (13) can be connected with at least one of a software and control signal memory, in which at least one of different electronic components, different software modules and different control signals can be stored, from which in dependence on the electronic component each detected by the detection means a software module suitable for the at least one of the detected electronic component and suitable control signals can automatically be at least one of selected and derived by the data processing means (13).

5. The gaming, betting or entertainment machine according to claim 1, wherein the data processing means (13) of the first module varies the at least one of the actuation of the display device (2), the actuation of the operating means and assignment of the operating means in dependence on the respectively detected electronic component, and is adapted to automatically vary the control of the second module including the display device and the control of the first module including the operating means.

* * * * *